US011448440B2

(12) United States Patent
Yajima

(10) Patent No.: US 11,448,440 B2
(45) Date of Patent: Sep. 20, 2022

(54) REFRIGERANT CYCLE APPARATUS HAVING REFRIGERANT LEAK DETECTOR USED TO CONTROL FIRST AND SECOND SHUTOFF VALVES

(71) Applicant: DAIKIN INDUSTRIES, LTD., Osaka (JP)

(72) Inventor: Ryuuzaburou Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/427,488

(22) PCT Filed: Jan. 27, 2020

(86) PCT No.: PCT/JP2020/002729
§ 371 (c)(1),
(2) Date: Nov. 30, 2021

(87) PCT Pub. No.: WO2020/158652
PCT Pub. Date: Aug. 6, 2020

(65) Prior Publication Data

US 2022/0090833 A1 Mar. 24, 2022

(30) Foreign Application Priority Data

Jan. 31, 2019 (JP) ..... JP2019-016406

(51) Int. Cl.
*F25B 49/00* (2006.01)
*F24F 11/36* (2018.01)

(52) U.S. Cl.
CPC ..... *F25B 49/005* (2013.01); *F24F 11/36* (2018.01); *F25B 2500/19* (2013.01); *F25B 2500/222* (2013.01); *F25B 2600/2519* (2013.01)

(58) Field of Classification Search
CPC ..... F24F 11/36; F25B 49/005; F25B 2500/22; F25B 2500/222; F25B 2500/19; F25B 2600/2519
See application file for complete search history.

(56) References Cited

U.S. PATENT DOCUMENTS

2014/0033754 A1* 2/2014 Hatomura ..... F24F 3/065 62/190
2015/0233622 A1 8/2015 Yajima et al.
(Continued)

FOREIGN PATENT DOCUMENTS

GB 2566201 A 3/2019
JP 2000-186863 A 7/2000
(Continued)

OTHER PUBLICATIONS

International Preliminary Report on Patentability and English translation of the Written Opinion of the International Searching Authority (Forms PCT/IB/338, PCT/IB/373, and PCT/ISA/237) for International Application No. PCT/JP2020/002729, dated Aug. 12, 2021.
(Continued)

*Primary Examiner* — Jonathan Bradford
(74) *Attorney, Agent, or Firm* — Birch, Stewart, Kolasch & Birch, LLP

(57) ABSTRACT

Excessive specifications of a shutoff valve leads to increase in production cost. An air conditioner configured to circulate a lower flammability refrigerant in a refrigerant circuit includes a first shutoff valve and a second shutoff valve configured to inhibit refrigerant leakage into a predetermined space. Each of the first shutoff valve and the second shutoff valve in a shutoff state has a shutoff leakage rate, as an air leakage rate in a case where fluid is air at 20° C. and a differential pressure between upstream and downstream of the valve is 1 MPa, more than 300 ($cm^3$/min) and less than 300×R ($cm^3$/min). R satisfies
(Continued)

$$R = (\rho_{md} \times V_{md} \times A_d) / \left( C_r \times (2 \times \Delta P_r / \rho_{1rl})^{0.5} \times A_v \times \rho_{1rl} + A_v \times (2/(\lambda+1))^{((\lambda+1)/2(\lambda-1))} \times (\lambda \times P_{1r} \times \rho_{1rg})^{0.5} \right).$$

4 Claims, 5 Drawing Sheets

(56) References Cited

U.S. PATENT DOCUMENTS

| | | | |
|---|---|---|---|
| 2017/0146274 | A1 | 5/2017 | Maeda et al. |
| 2018/0180338 | A1 | 6/2018 | Honda et al. |
| 2019/0368752 | A1 | 12/2019 | Shiohama et al. |

FOREIGN PATENT DOCUMENTS

| | | | |
|---|---|---|---|
| WO | WO 2014/034099 | A1 | 3/2014 |
| WO | WO 2015/152163 | A1 | 10/2015 |
| WO | WO 2016/208470 | A1 | 12/2016 |
| WO | WO 2018/011994 | A1 | 1/2018 |
| WO | WO 2018/131467 | A1 | 7/2018 |

OTHER PUBLICATIONS

"Guideline of design construction for ensuring safety against refrigerant leakage from commercial air conditioners using lower flammability (A2L) refrigerants (JRA GL-16: 2017)", The Japan Refrigeration and Air Conditioning Industry Association) and Annex A (Prescription) Specifications of Safety Shutoff Valves, total 31 pages.

"Report of risk assessment of building multi air conditioners using lower flammability refrigerants", Japan Refrigeration and Air Conditioning Industry Association, Sep. 20, 2017, total 189 pages.

International Search Report for PCT/JP2020/002729 dated Mar. 10, 2020.

Extended European Search Report for European Application No. 20747625.0, dated Feb. 11, 2022.

* cited by examiner

REFRIGERANT CYCLE APPARATUS HAVING REFRIGERANT LEAK DETECTOR USED TO CONTROL FIRST AND SECOND SHUTOFF VALVES

TECHNICAL FIELD

The present disclosure relates to a refrigerant cycle apparatus.

BACKGROUND ART

The "Guideline of design construction for ensuring safety against refrigerant leakage from commercial air conditioners using lower flammability (A2L) refrigerants" (JRA GL-16: 2017), as a guideline issued by the Japan Refrigeration and Air Conditioning Industry Association on Sep. 1, 2017, prescribes selection and construction of an air conditioning system as well as construction measures such as ventilation, for ensured safety against leakage of a lower flammability (A2L) refrigerant filled in a commercial air conditioner using the refrigerant. Examples of the refrigerant categorized in such lower flammability (A2L) refrigerants include R32, R1234yf, and R1234ze.

This guideline is prepared by the Japan Refrigeration and Air Conditioning Industry Association for ensured safety of use of lower flammability (A2L) refrigerants useful in terms of prevention of global warming. The guideline describes various matters such as detectors configured to detect refrigerant leakage, alarm devices, and safety shutoff valves.

SUMMARY OF THE INVENTION

Technical Problem

The guideline prescribes that, a safety shutoff valve adopted as a safety measure should be disposed at an appropriate position in a refrigerant circuit to be shut off such that a target living room (room) upon refrigerant leakage has a refrigerant leakage maximum concentration equal to or less than one fourth of a lower flammability limit (LFL). The guideline also prescribes that the refrigerant circuit should be shut off in accordance with a signal from the detector configured to detect refrigerant leakage.

The safety shutoff valve is configured to shut off a refrigerant leaking from a refrigerant circuit into a refrigerant leakage space upon refrigerant leakage. The LFL is a refrigerant minimum concentration specified by ISO 817 and enabling flame propagation in a state where a refrigerant and air are mixed uniformly. The refrigerant leakage maximum concentration is obtained by dividing total refrigerant quantity in a refrigerant circuit by a capacity of a space reserving the refrigerant (a value obtained by multiplying a leakage height and a floor area).

The guideline includes "Annex A (Prescription) Specifications of safety shutoff valves" as to specifications of safety shutoff valves, which should satisfy predetermined specifications. One of the specifications of the safety shutoff valves to be satisfied is a closed valve leakage rate. Specifically, when fluid is air and a safety shutoff valve has 1 MPa as a differential pressure between upstream and downstream of the safety shutoff valve, 300 ($cm^3$/min) or less is prescribed as the closed valve leakage rate to be satisfied by the safety shutoff valve.

A safety shutoff valve satisfying this required specification is expected to have a quite small refrigerant leakage rate while the valve is closed for reliably ensured safety. However, this specification may be excessive depending on a place equipped with the refrigerant circuit and a type of the refrigerant, which may uselessly raise production cost for a refrigerant cycle apparatus.

Solutions to Problem

The inventor of the present application has found that the safety requirement can be satisfied depending on conditions even in a case where a valve not satisfying the specifications prescribed by the guideline is adopted as a safety shutoff valve.

A refrigerant cycle apparatus according to a first aspect is configured to circulate a lower flammability refrigerant in a refrigerant circuit, and includes a first shutoff valve, a second shutoff valve, a detection unit, and a control unit. The first shutoff valve and the second shutoff valve are provided on both sides of a first portion of the refrigerant circuit. The detection unit detects refrigerant leakage from the first portion of the refrigerant circuit into a predetermined space. When the detection unit detects refrigerant leakage into the predetermined space, the control unit brings each of the first shutoff valve and the second shutoff valve into a shutoff state to inhibit refrigerant leakage into the predetermined space. Each of the first shutoff valve and the second shutoff valve in the shutoff state has a shutoff leakage rate, as an air leakage rate in a case where fluid is air at 20° C. and a differential pressure between upstream and downstream of the valve is 1 MPa, more than 300 ($cm^3$/min) and less than 300×R ($cm^3$/min).

R satisfies $$R = (\rho_{md} \times V_{md} \times A_d)/\left(C_r \times (2 \times \Delta P_r/\rho_{1rl})^{0.5} \times A_v \times \rho_{1rl} + A_v \times (2/(\lambda+1))^{((\lambda+1)/2(\lambda-1))} \times (\lambda \times P_{1r} \times \rho_{1rg})^{0.5}\right).$$

$A_v$ is a valve clearance sectional area ($m^2$) of each of the first shutoff valve and the second shutoff valve in the shutoff state.

$\rho_{1rl}$ is a mass concentration ($kg/m^3$) of a refrigerant in a liquid phase.

$\rho_{1rg}$ is a mass concentration ($kg/m^3$) of a refrigerant in a gas phase.

$P_{1r}$ is an upstream refrigerant pressure (MPa) of each of the first shutoff valve and the second shutoff valve.

$\lambda$ is a refrigerant specific heat ratio.

$\rho_{md}$ is a mass concentration ($kg/m^3$) of a gaseous mixture containing air and a refrigerant and passing a clearance of a door partitioning into inside and outside the predetermined space.

$V_{md}$ is a velocity (m/s) of the gaseous mixture containing air and the refrigerant and passing the clearance of the door partitioning into inside and outside the predetermined space.

$A_d$ is an area ($m^2$) of the clearance of the door partitioning into inside and outside the predetermined space.

$\Delta P_r$ is a pressure difference (Pa) between inside and outside a hole at a position where the refrigerant leaks.

$C_r$ is 0.6 as a flow rate coefficient of the refrigerant in a case where the refrigerant in the liquid phase passes the hole at the position where the refrigerant leaks.

The shutoff leakage rate is synonymous with a closed valve leakage rate according to the guideline.

The refrigerant cycle apparatus according to the first aspect adopts the first shutoff valve and the second shutoff valve. The first shutoff valve and the second shutoff valve each have the shutoff leakage rate more than 300 ($cm^3$/min) and less than 300×R ($cm^3$/min). In an exemplary case where R32 is adopted as the refrigerant, the first portion of the refrigerant circuit is positioned at the height of 2.2 m from a floor of the predetermined space, and one fourth of the lower flammability limit (LFL) specified by ISO 817 corresponds to a tolerable refrigerant concentration in the predetermined space, R=1.96 is satisfied. In this case, each of the first shutoff valve and the second shutoff valve has the shutoff leakage rate (as mentioned above, the air leakage rate in the case where the fluid is air at 20° C. and the differential pressure between upstream and downstream of the valve is 1 MPa), which may be more than 300 ($cm^3$/min) and less than 300×1.96 ($cm^3$/min). In other words, each of the first shutoff valve and the second shutoff valve does not need to be an expensive valve having a shutoff leakage rate equal to or less than 300 ($cm^3$/min), but may be an inexpensive valve having a shutoff leakage rate of about 550 ($cm^3$/min) or the like.

As described above, the refrigerant cycle apparatus according to the first aspect can adopt relatively inexpensive valves as the first shutoff valve and the second shutoff valve, for reduction in production cost.

A refrigerant cycle apparatus according to a second aspect is the refrigerant cycle apparatus according to the first aspect, in which R satisfies $1<R<10.1$.

The Japan Refrigeration and Air Conditioning Industry Association issuing the guideline collected refrigerant cycle apparatuses actually having refrigerant leakage from the market and checked diameters of holes causing refrigerant leakage, to find 0.174 mm as a maximum hole diameter (see "Report of risk assessment of building multi air conditioners using lower flammability refrigerants" by the Japan Refrigeration and Air Conditioning Industry Association (issued on Sep. 20, 2017)).

The hole having this diameter has an area corresponding to 10.1 times the sectional area of the valve clearance of each of the first shutoff valve and the second shutoff valve in the shutoff state in the case where the shutoff leakage rate is 300 ($cm^3$/min). If R is 10.1 or more and the shutoff leakage rate of each of the first shutoff valve and the second shutoff valve reaches 300×10.1 ($cm^3$/min), the valve clearance sectional area becomes equal to or more than the area of the hole causing refrigerant leakage. In this case, the refrigerant is not substantially shut off, and the first shutoff valve and the second shutoff valve are installed uselessly.

In view of this, the refrigerant cycle apparatus according to the second aspect has R set to have the upper limit of 10.1.

A refrigerant cycle apparatus according to a third aspect is the refrigerant cycle apparatus according to the first or second aspect, in which the refrigerant circuit includes a utilization circuit, a heat source circuit, and a liquid-refrigerant connection pipe and a gas-refrigerant connection pipe connecting the utilization circuit and the heat source circuit. The utilization circuit is part of the refrigerant circuit and is included in a utilization unit provided in the predetermined space or a space communicating with the predetermined space. The heat source circuit is part of the refrigerant circuit and is included in a heat source unit. The first portion of the refrigerant circuit, as a refrigerant leakage detection target of the detection unit, corresponds to the utilization circuit. The first shutoff valve is provided on the liquid-refrigerant connection pipe. The second shutoff valve is provided on the gas-refrigerant connection pipe.

A refrigerant cycle apparatus according to a fourth aspect is the refrigerant cycle apparatus according to any one of the first to third aspects, in which the lower flammability refrigerant is categorized in lower flammability (A2L) refrigerants by ISO 817.

DESCRIPTION OF EMBODIMENTS

(1) Configuration of Air Conditioner

Figure 1:
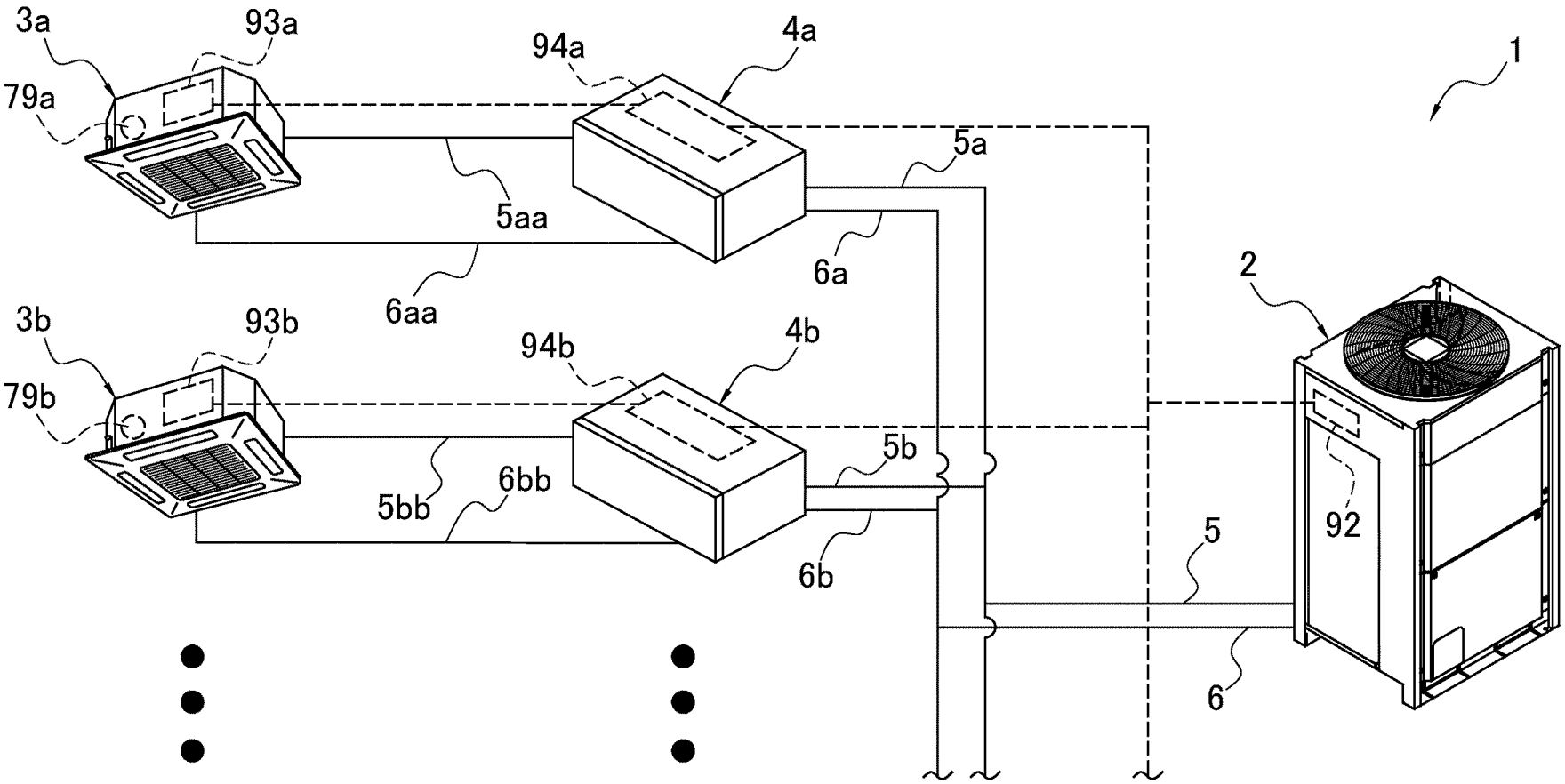
FIG. 1 is a diagram depicting a schematic configuration of an air conditioner as a refrigerant cycle apparatus according to an embodiment.
Figure 2:
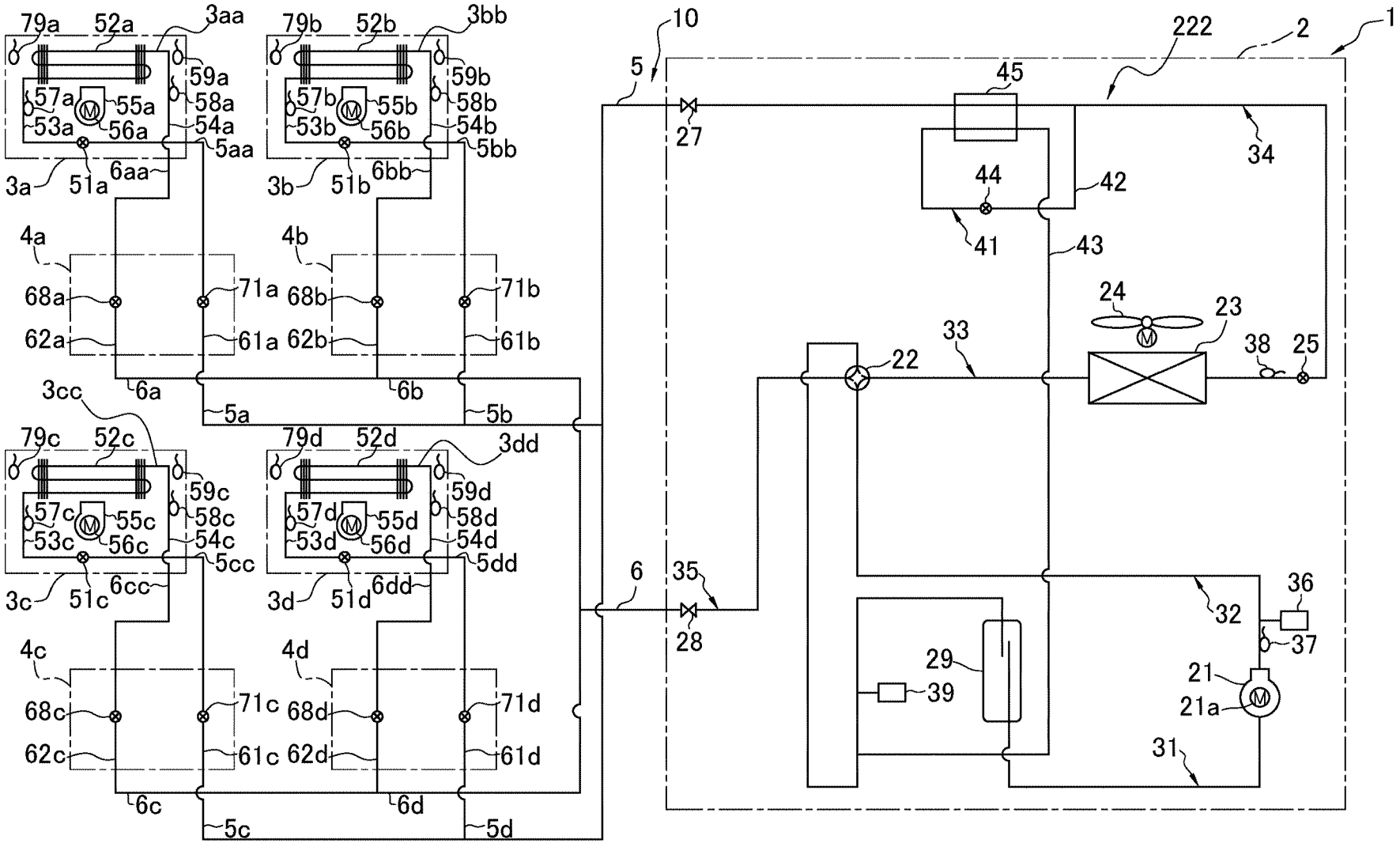
FIG. 2 is a diagram depicting a refrigerant circuit of the air conditioner.

As depicted in FIG. 1 and FIG. 2, an air conditioner 1 as a refrigerant cycle apparatus according to an embodiment is configured to cool or heat a room in a building by means of a vapor compression refrigeration cycle. The air conditioner 1 principally includes a heat source unit 2, a plurality of utilization units 3*a*, 3*b*, 3*c*, and 3*d*, relay units 4*a*, 4*b*, 4*c*, and 4*d* connected to the utilization units 3*a*, 3*b*, 3*c*, and 3*d*, refrigerant connection pipes 5 and 6, and a control unit 19 (see FIG. 4). The plurality of utilization units 3*a*, 3*b*, 3*c*, and 3*d* is connected in parallel to the heat source unit 2. The refrigerant connection pipes 5 and 6 connect the heat source unit 2 and the utilization units 3*a*, 3*b*, 3*c*, and 3*d* via the relay units 4*a*, 4*b*, 4*c*, and 4*d*. The control unit 19 controls constituent devices of the heat source unit 2, the utilization units 3*a*, 3*b*, 3*c*, and 3*d*, and the relay units 4*a*, 4*b*, 4*c*, and 4*d*. As depicted in FIG. 2, the air conditioner 1 includes a vapor compression refrigerant circuit 10 including a heat source circuit 222 of the heat source unit 2, utilization circuits 3*aa*, 3*bb*, 3*cc*, and 3*dd* of the utilization units 3*a*, 3*b*, 3*c*, and 3*d*, liquid connecting pipes 61*a*, 61*b*, 61*c*, and 61*d* and gas connecting pipes 62*a*, 62*b*, 62*c*, and 62*d* of the relay units 4*a*, 4*b*, 4*c*, and 4*d*, and the refrigerant connection pipes 5 and 6, which are connected to constitute the refrigerant circuit 10.

The refrigerant circuit 10 is filled with R32 as a refrigerant. When R32 leaks from the refrigerant circuit 10 into a room SP (see FIG. 3) which is thus increased in refrigerant concentration, combustibility of the refrigerant may cause a combustion accident. Such a combustion accident needs to be prevented.

The utilization units 3*a*, 3*b*, 3*c*, and 3*d* in the air conditioner 1 are switched to cooling operation or heating operation by a switching mechanism 22 included in the heat source unit 2.

(1-1) Refrigerant Connection Pipe

The liquid-refrigerant connection pipe 5 principally includes a junction pipe extending from the heat source unit 2, a plurality of (four herein) first branching pipes 5*a*, 5*b*, 5*c*, and 5*d* branching upstream of the relay units 4*a*, 4*b*, 4*c*, and 4*d*, and second branching pipes 5*aa*, 5*bb*, 5*cc*, and 5*dd* connecting the relay units 4*a*, 4*b*, 4*c*, and 4*d* and the utilization units 3*a*, 3*b*, 3*c*, and 3*d*.

The gas-refrigerant connection pipe 6 principally includes a junction pipe extending from the heat source unit 2, a plurality of (four herein) first branching pipes 6*a*, 6*b*, 6*c*, and 6*d* branching upstream of the relay units 4*a*, 4*b*, 4*c*, and 4*d*, and second branching pipes 6*aa*, 6*bb*, 6*cc*, and 6*dd* connecting the relay units 4*a*, 4*b*, 4*c*, and 4*d* and the utilization units 3*a*, 3*b*, 3*c*, and 3*d*.

(1-2) Utilization Unit

The utilization units 3*a*, 3*b*, 3*c*, and 3*d* are installed in a room of a building or the like. As described above, the utilization units 3*a*, 3*b*, 3*c*, and 3*d* are connected to the heat source unit 2 via the liquid-refrigerant connection pipe 5, the gas-refrigerant connection pipe 6, and the relay units 4*a*, 4*b*, 4*c*, and 4*d*, to constitute part of the refrigerant circuit 10.

The utilization units 3*a*, 3*b*, 3*c*, and 3*d* will be described next in terms of their configurations. The utilization unit 3*a* and the utilization units 3*b*, 3*c*, and 3*d* are configured similarly. The configuration of only the utilization unit 3*a* will thus be described herein. As to the configuration of each of the utilization units 3*b*, 3*c*, and 3*d*, elements of each of the utilization units 3*b*, 3*c*, and 3*d* will be denoted by reference signs obtained by replacing a subscript "a" in reference signs of elements of the utilization unit 3*a* with a subscript "b", "c", or "d", and these elements will not be described repeatedly.

The utilization unit 3*a* principally includes a utilization expansion valve 51*a* and a utilization heat exchanger 52*a*. The utilization unit 3*a* further includes a utilization liquid-refrigerant pipe 53*a* connecting a liquid side end of the utilization heat exchanger 52*a* and the liquid-refrigerant connection pipe 5 (the branching pipe 5*aa* in this case), and a utilization gas-refrigerant pipe 54*a* connecting a gas side end of the utilization heat exchanger 52*a* and the gas-refrigerant connection pipe 6 (the second branching pipe 6*aa* in this case). The utilization liquid-refrigerant pipe 53*a*, the utilization expansion valve 51*a*, the utilization heat exchanger 52*a*, and the utilization gas-refrigerant pipe 54*a* constitute the utilization circuit 3*aa* of the utilization unit 3*a*.

The utilization expansion valve 51*a* is an electrically powered expansion valve configured to decompress a refrigerant as well as adjust a flow rate of the refrigerant flowing in the utilization heat exchanger 52*a*, and is provided on the utilization liquid-refrigerant pipe 53*a*.

The utilization heat exchanger 52*a* functions as a refrigerant evaporator configured to cool indoor air, or functions as a refrigerant radiator configured to heat indoor air. The utilization unit 3*a* includes a utilization fan 55*a*. The utilization fan 55*a* supplies the utilization heat exchanger 52*a* with indoor air as a cooling source or a heating source for the refrigerant flowing in the utilization heat exchanger 52*a*. The utilization fan 55*a* is driven by a utilization fan motor 56*a*.

The utilization unit 3*a* includes various sensors. Specifically, the utilization unit 3*a* includes a utilization heat exchange liquid-side sensor 57*a* configured to detect refrigerant temperature at the liquid side end of the utilization heat exchanger 52*a*, a utilization heat exchange gas-side sensor 58*a* configured to detect refrigerant temperature at the gas side end of the utilization heat exchanger 52*a*, and an indoor air sensor 59*a* configured to detect temperature of indoor air sucked into the utilization unit 3*a*. The utilization unit 3*a* further includes a refrigerant leakage detection unit 79*a* configured to refrigerant leakage. Examples of the refrigerant leakage detection unit 79*a* can include a semiconductor gas sensor and a detection unit configured to detect rapid decrease in refrigerant pressure in the utilization unit 3*a*. The semiconductor gas sensor adopted as the refrigerant leakage detection unit 79*a* is connected to a utilization control unit 93*a* (see FIG. 4). When the detection unit configured to detect rapid decrease in refrigerant pressure is adopted as the refrigerant leakage detection unit 79*a*, a pressure sensor is installed on a refrigerant pipe and the utilization control unit 93*a* includes a detection algorithm for determination of refrigerant leakage according to change in sensor value thereof.

The refrigerant leakage detection unit 79*a* is provided at the utilization unit 3*a* in this case. However, the present disclosure is not limited to this configuration, and the refrigerant leakage detection unit 79*a* may alternatively be provided at a remote controller configured to operate the utilization unit 3*a*, in an indoor space as an air conditioning target of the utilization unit 3*a*, or the like.

(1-3) Heat Source Unit

The heat source unit 2 is placed outside a building, for example, on a roof or on the ground. As described above, the heat source unit 2 is connected to the utilization units 3*a*, 3*b*, 3*c*, and 3*d* via the liquid-refrigerant connection pipe 5, the gas-refrigerant connection pipe 6, and the relay units 4*a*, 4*b*, 4*c*, and 4*d*, to constitute part of the refrigerant circuit 10.

The heat source unit 2 principally includes a compressor 21 and a heat source heat exchanger 23. The heat source unit 2 further includes the switching mechanism 22 functioning as a cooling-heating switching mechanism configured to switch between a cooling operation state where the heat source heat exchanger 23 functions as a refrigerant radiator and utilization heat exchangers 52*a*, 52*b*, 52*c*, and 52*d* each function as a refrigerant evaporator, and a heating operation state where the heat source heat exchanger 23 functions as a refrigerant evaporator and the utilization heat exchangers 52*a*, 52*b*, 52*c*, and 52*d* each function as a refrigerant radiator. The switching mechanism 22 and a suction side of the compressor 21 are connected via a sucked refrigerant pipe 31. The sucked refrigerant pipe 31 is provided with an accumulator 29 configured to temporarily accumulate a refrigerant sucked into the compressor 21. The switching mechanism 22 and a discharge side of the compressor 21 are connected via a discharged refrigerant pipe 32. The switching mechanism 22 and a gas side end of the heat source heat exchanger 23 are connected via a first heat source gas-refrigerant pipe 33. The liquid-refrigerant connection pipe 5 and a liquid side end of the heat source heat exchanger 23 are connected via a heat source liquid-refrigerant pipe 34. The heat source liquid-refrigerant pipe 34 and the liquid-refrigerant connection pipe 5 are connected at a portion provided with a liquid-side shutoff valve 27. The switching mechanism 22 and the gas-refrigerant connection pipe 6 are connected via a second heat source gas-refrigerant pipe 35. The second heat source gas-refrigerant pipe 35 and the gas-refrigerant connection pipe 6 are connected at a portion provided with a gas-side shutoff valve 28. The liquid-side shutoff valve 27 and the gas-side shutoff valve 28 are configured to be manually opened and closed. The liquid-side shutoff valve 27 and the gas-side shutoff valve 28 are opened during operation. The sucked refrigerant pipe 31, the compressor 21, the discharged refrigerant pipe 32, the first heat source gas-refrigerant pipe 33, the heat source heat exchanger 23, the heat source liquid-refrigerant pipe 34, the second heat source gas-refrigerant pipe 35, and the like constitute the heat source circuit 222 of the heat source unit 2.

The compressor 21 is configured to compress a refrigerant, and examples of the compressor include a compressor having a hermetic structure and including a compression element (not depicted) of a positive-displacement type such as a rotary type or a scroll type, configured to be rotary driven by a compressor motor 21*a*.

The switching mechanism 22 is configured to switch a flow of a refrigerant in the refrigerant circuit 10, and is exemplarily constituted by a four-way switching valve. In a case where the heat source heat exchanger 23 functions as a refrigerant radiator and the utilization heat exchangers 52*a*, 52*b*, 52*c*, and 52*d* each function as a refrigerant evaporator (hereinafter, called the "cooling operation state"), the switching mechanism 22 connects the discharge side of the compressor 21 and the gas side of the heat source heat exchanger 23 (see a solid line for the switching mechanism 22 in FIG. 2). In another case where the heat source heat exchanger 23 functions as a refrigerant evaporator and the utilization heat exchangers 52*a*, 52*b*, 52*c*, and 52*d* each function as a refrigerant radiator (hereinafter, called the "heating operation state"), the switching mechanism 22 connects the suction side of the compressor 21 and the gas side of the heat source heat exchanger 23 (see a broken line for the first switching mechanism 22 in FIG. 2).

The heat source heat exchanger 23 functions as a refrigerant radiator, or functions as a refrigerant evaporator. The heat source unit 2 includes a heat source fan 24. The heat source fan 24 sucks outdoor air into the heat source unit 2, causes the outdoor air thus sucked to exchange heat with the refrigerant in the heat source heat exchanger 23, and discharges the outdoor air having exchanged heat to the outside. The heat source fan 24 is driven by a heat source fan motor.

During cooling operation, the air conditioner 1 causes the refrigerant to flow from the heat source heat exchanger 23, via the liquid-refrigerant connection pipe 5 and the relay units 4*a*, 4*b*, 4*c*, and 4*d*, to the utilization heat exchangers 52*a*, 52*b*, 52*c*, and 52*d* each functioning as a refrigerant evaporator. During heating operation, the air conditioner 1 causes the refrigerant to flow from the compressor 21, via the gas-refrigerant connection pipe 6 and the relay units 4*a*, 4*b*, 4*c*, and 4*d*, to the utilization heat exchangers 52*a*, 52*b*, 52*c*, and 52*d* each functioning as a refrigerant radiator. During cooling operation, the switching mechanism 22 is switched into the cooling operation state where the heat source heat exchanger 23 functions as a refrigerant radiator and the refrigerant flows from the heat source unit 2 to the utilization units 3*a*, 3*b*, 3*c*, and 3*d* via the liquid-refrigerant connection pipe 5 and the relay units 4*a*, 4*b*, 4*c*, and 4*d*. During heating operation, the switching mechanism 22 is switched into the heating operation state where the refrigerant flows from the utilization units 3*a*, 3*b*, 3*c*, and 3*d* to the heat source unit 2 via the liquid-refrigerant connection pipe 5 and the relay units 4*a*, 4*b*, 4*c*, and 4*d* and the heat source heat exchanger 23 functions as a refrigerant evaporator.

The heat source liquid-refrigerant pipe 34 is provided with a heat source expansion valve 25 in this case. The heat source expansion valve 25 is an electrically powered expansion valve configured to decompress a refrigerant during heating operation, and is provided on the heat source liquid-refrigerant pipe 34, at a portion adjacent to the liquid side end of the heat source heat exchanger 23.

The heat source liquid-refrigerant pipe 34 is connected with a refrigerant return pipe 41 and is provided with a refrigerant cooler 45. The refrigerant return pipe 41 causes part of the refrigerant flowing in the heat source liquid-refrigerant pipe 34 to branch to be sent to the compressor 21. The refrigerant cooler 45 cools the refrigerant flowing in the heat source liquid-refrigerant pipe 34 by means of the refrigerant flowing in the refrigerant return pipe 41. The heat source expansion valve 25 is provided on the heat source liquid-refrigerant pipe 34, at a portion closer to the heat source heat exchanger 23 rather than the refrigerant cooler 45.

The refrigerant return pipe 41 is a refrigerant pipe causing the refrigerant branching from the heat source liquid-refrigerant pipe 34 to be sent to the suction side of the compressor 21. The refrigerant return pipe 41 principally includes a refrigerant return inlet pipe 42 and a refrigerant return outlet pipe 43. The refrigerant return inlet pipe 42 causes part of the refrigerant flowing in the heat source liquid-refrigerant pipe 34 to branch from a portion between the liquid side end of the heat source heat exchanger 23 and the liquid-side shutoff valve 27 (a portion between the heat source expansion valve 25 and the refrigerant cooler 45 in this case) and be sent to an inlet, adjacent to the refrigerant return pipe 41, of the refrigerant cooler 45. The refrigerant return inlet pipe 42 is provided with a refrigerant return expansion valve 44. The refrigerant return expansion valve 44 decompresses the refrigerant flowing in the refrigerant return pipe 41 as well as adjusts a flow rate of the refrigerant flowing in the refrigerant cooler 45. The refrigerant return expansion valve 44 is configured as an electrically powered expansion valve. The refrigerant return outlet pipe 43 causes the refrigerant to be sent from an outlet, adjacent to the refrigerant return pipe 41, of the refrigerant cooler 45 to the sucked refrigerant pipe 31. The refrigerant return outlet pipe 43 of the refrigerant return pipe 41 is connected to the sucked refrigerant pipe 31, at a portion adjacent to an inlet of the accumulator 29. The refrigerant cooler 45 cools the refrigerant flowing in the heat source liquid-refrigerant pipe 34 by means of the refrigerant flowing in the refrigerant return pipe 41.

The heat source unit 2 includes various sensors. Specifically, the heat source unit 2 includes a discharge pressure sensor 36 configured to detect pressure (discharge pressure) of the refrigerant discharged from the compressor 21, a discharge temperature sensor 37 configured to detect temperature (discharge temperature) of the refrigerant discharged from the compressor 21, and a suction pressure sensor 39 configured to detect pressure (suction pressure) of the refrigerant sucked into the compressor 21. The heat source unit 2 further includes a heat source heat exchange liquid-side sensor 38 configured to detect temperature (heat source heat exchange outlet temperature) of the refrigerant at the liquid side end of the heat source heat exchanger 23.

(1-4) Relay Unit

The relay units 4*a*, 4*b*, 4*c*, and 4*d* are installed in a space SP1 behind a ceiling of the room SP (see FIG. 3) in a building. The relay units 4*a*, 4*b*, 4*c*, and 4*d*, as well as the liquid-refrigerant connection pipe 5 and the gas-refrigerant connection pipe 6, are interposed between the utilization units 3*a*, 3*b*, 3*c*, and 3*d* and the heat source unit 2, to constitute part of the refrigerant circuit 10. The relay units 4*a*, 4*b*, 4*c*, and 4*d* may be disposed adjacent to the utilization units 3*a*, 3*b*, 3*c*, and 3*d*, may be disposed far from the utilization units 3*a*, 3*b*, 3*c*, and 3*d*, or may be disposed collectively at one point.

The relay units 4*a*, 4*b*, 4*c*, and 4*d* will be described next in terms of their configurations. The relay unit 4*a* and the relay units 4*b*, 4*c*, and 4*d* are configured similarly. The configuration of only the relay unit 4*a* will thus be described herein. As to the configuration of each of the relay units 4*b*, 4*c*, and 4*d*, elements of each of the relay units 4*b*, 4*c*, and 4*d* will be denoted by reference signs obtained by replacing a subscript "a" in reference signs of elements of the relay unit 4*a* with a subscript "b", "c", or "d", and these elements will not be described repeatedly.

The relay unit 4*a* principally includes the liquid connecting pipe 61*a* and the gas connecting pipe 62*a*.

The liquid connecting pipe 61*a* has a first end connected to the first branching pipe 5*a* of the liquid-refrigerant connection pipe 5, and a second end connected to the second branching pipe 5*aa* of the liquid-refrigerant connection pipe 5. The liquid connecting pipe 61*a* is provided with a liquid relay shutoff valve 71*a*. The liquid relay shutoff valve 71*a* is configured as an electrically powered expansion valve.

The gas connecting pipe 62*a* has a first end connected to the first branching pipe 6*a* of the gas-refrigerant connection pipe 6, and a second end connected to the second branching pipe 6*aa* of the gas-refrigerant connection pipe 6. The gas connecting pipe 62*a* is provided with a gas relay shutoff valve 68*a*. The gas relay shutoff valve 68*a* is configured as an electrically powered expansion valve.

The liquid relay shutoff valve 71*a* and the gas relay shutoff valve 68*a* are fully opened during cooling operation and heating operation.

(1-5) Control Unit

Figure 4:
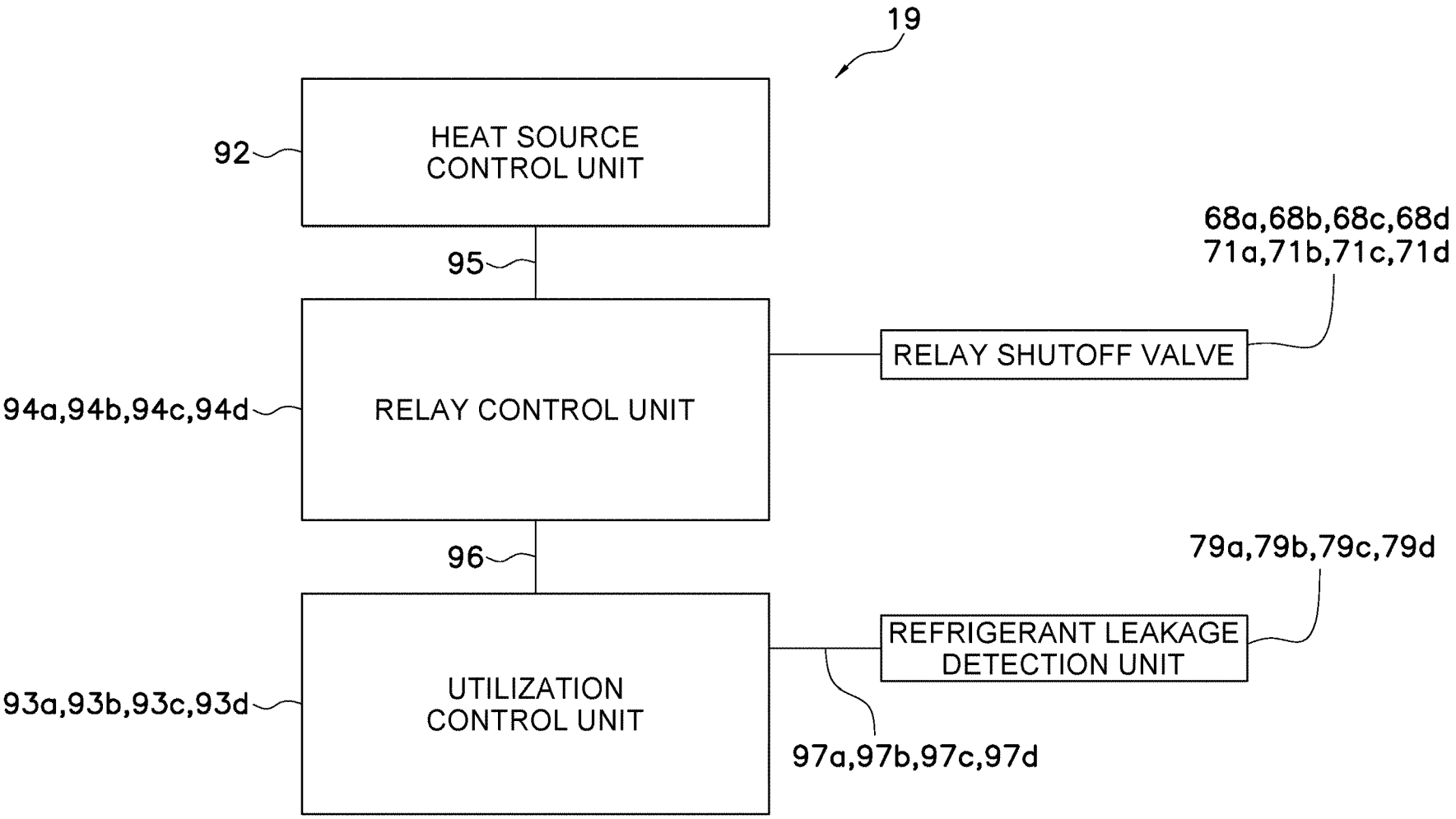
FIG. 4 is a control block diagram of the air conditioner.

As depicted in FIG. 4, the control unit 19 includes a heat source control unit 92, relay control units 94*a*, 94*b*, 94*c*, and 94*d*, and utilization control units 93*a*, 93*b*, 93*c*, and 93*d*, which are connected via transmission lines 95 and 96 to constitute the control unit 19. The heat source control unit 92 controls constituent devices of the heat source unit 2. The relay control units 94*a*, 94*b*, 94*c*, and 94*d* control the constituent devices of the relay units 4*a*, 4*b*, 4*c*, and 4*d*. The utilization control units 93*a*, 93*b*, 93*c*, and 93*d* control the constituent devices of the utilization units 3*a*, 3*b*, 3*c*, and 3*d*. The heat source control unit 92 provided at the heat source unit 2, the relay control units 94*a*, 94*b*, 94*c*, and 94*d* provided at the relay units 4*a*, 4*b*, 4*c*, and 4*d*, and the utilization control units 93*a*, 93*b*, 93*c*, and 93*d* provided at the utilization units 3*a*, 3*b*, 3*c*, and 3*d* are configured to mutually transmit and receive information such a control signal via the transmission lines 95 and 96.

The heat source control unit 92 includes a control board mounted with electric components such as a microcomputer and a memory, and is connected with various constituent devices 21, 22, 24, 25, and 44 and the various sensors 36, 37, 38, and 39 in the heat source unit 2. The relay control units 94*a*, 94*b*, 94*c*, and 94*d* each include a control board mounted with electric components such as a microcomputer and a memory, and are connected with gas relay shutoff valves 68*a* to 68*d* and liquid relay shutoff valves 71*a* to 71*d* of the relay units 4*a*, 4*b*, 4*c*, and 4*d*. The relay control units 94*a*, 94*b*, 94*c*, and 94*d* and the heat source control unit 92 are connected via the first transmission line 95. The utilization control units 93*a*, 93*b*, 93*c*, and 93*d* each include a control board mounted with electric components such as a microcomputer and a memory, and are connected with various constituent devices 51*a* to 51*d* and 55*a* to 55*d* of the utilization units 3*a*, 3*b*, 3*c*, and 3*d* and various sensors 57*a* to 57*d*, 58*a* to 58*d*, 59*a* to 59*d*, and 79*a* to 79*d*. Assume that the refrigerant leakage detection units 79*a*, 79*b*, 79*c*, and 79*d* are connected to the utilization control units 93*a*, 93*b*, 93*c*, and 93*d* via wires 97*a*, 97*b*, 97*c*, and 97*d*. The utilization control units 93*a*, 93*b*, 93*c*, and 93*d* and the relay control units 94*a*, 94*b*, 94*c*, and 94*d* are connected via the second transmission line 96.

In this manner, the control unit 19 controls operation of the entire air conditioner 1. Specifically, the control unit 19 controls the various constituent devices 21, 22, 24, 25, 44, 51*a* to 51*d*, 55*a* to 55*d*, 68*a* to 68*d*, and 71*a* to 71*d* of the air conditioner 1 (the heat source unit 2, the utilization units 3*a*, 3*b*, 3*c*, and 3*d*, and the relay units 4*a*, 4*b*, 4*c*, and 4*d* in this case) in accordance with detection signals of the various sensors 36, 37, 38, 39, 57*a* to 57*d*, 58*a* to 58*d*, 59*a* to 59*d*, and 79*a* to 79*d*.

(2) Basic Operation of Air Conditioner

The air conditioner 1 will be described next in terms of its basic operation. As described above, the basic operation of the air conditioner 1 includes cooling operation and heating operation. The following basic operation of the air conditioner 1 is executed by the control unit 19 configured to control the constituent devices of the air conditioner 1 (the heat source unit 2, the utilization units 3*a*, 3*b*, 3*c*, and 3*d*, and the relay units 4*a*, 4*b*, 4*c*, and 4*d*).

(2-1) Cooling Operation

During cooling operation in an exemplary case where all the utilization units 3*a*, 3*b*, 3*c*, and 3*d* execute cooling operation (operation by each one of the utilization heat exchangers 52*a*, 52*b*, 52*c*, and 52*d* functioning as a refrigerant evaporator and the heat source heat exchanger 23 functioning as a refrigerant radiator), the switching mechanism 22 is switched into the cooling operation state (the state depicted by the solid line for the switching mechanism 22) to drive the compressor 21, the heat source fan 24, and the utilization fans 55*a*, 55*b*, 55*c*, and 55*d*. Furthermore, the liquid relay shutoff valves 71*a*, 71*b*, 71*c*, and 71*d* and the gas relay shutoff valves 68*a*, 68*b*, 68*c*, and 68*d* of the relay units 4*a*, 4*b*, 4*c*, and 4*d* are fully opened.

The utilization control units 93*a*, 93*b*, 93*c*, and 93*d* operate the various constituent devices of the utilization units 3*a*, 3*b*, 3*c*, and 3*d* in this case. The utilization control units 93*a*, 93*b*, 93*c*, and 93*d* transmit information indicating that the utilization units 3*a*, 3*b*, 3*c*, and 3*d* execute cooling operation to the heat source control unit 92 and the relay control units 94*a*, 94*b*, 94*c*, and 94*d* via the transmission lines 95 and 96. The various devices of the heat source unit 2 and the relay units 4*a*, 4*b*, 4*c*, and 4*d* are operated by the heat source control unit 92 and the relay control units 94*a*, 94*b*, 94*c*, and 94*d* having received information from the utilization units 3*a*, 3*b*, 3*c*, and 3*d*.

During cooling operation, a high-pressure refrigerant discharged from the compressor 21 is sent to the heat source heat exchanger 23 via the switching mechanism 22. The refrigerant sent to the heat source heat exchanger 23 exchanges heat with outdoor air supplied by the heat source fan 24 in the heat source heat exchanger 23 functioning as a refrigerant radiator, so as to be cooled and condensed. This refrigerant flows out of the heat source unit 2 via the heat source expansion valve 25, the refrigerant cooler 45, and the liquid-side shutoff valve 27. In the refrigerant cooler 45, the refrigerant flowing in the refrigerant return pipe 41 cools the refrigerant flowing out of the heat source unit 2.

The refrigerant having flown out of the heat source unit 2 is branched to be sent to the relay units 4*a*, 4*b*, 4*c*, and 4*d* via the liquid-refrigerant connection pipe 5 (the junction pipe and the first branching pipes 5*a*, 5*b*, 5*c*, and 5*d*). The refrigerant sent to the relay units 4*a*, 4*b*, 4*c*, and 4*d* flows out of the relay units 4*a*, 4*b*, 4*c*, and 4*d* via the liquid relay shutoff valves 71*a*, 71*b*, 71*c*, and 71*d*.

The refrigerant having flown out of the relay units 4*a*, 4*b*, 4*c*, and 4*d* is sent to the utilization units 3*a*, 3*b*, 3*c*, and 3*d* via the second branching pipes 5*aa*, 5*bb*, 5*cc*, and 5*dd* (portions included in the liquid-refrigerant connection pipe 5 and connecting the relay units 4*a*, 4*b*, 4*c*, and 4*d* and the utilization units 3*a*, 3*b*, 3*c*, and 3*d*). The refrigerant sent to the utilization units 3*a*, 3*b*, 3*c*, and 3*d* is decompressed by the utilization expansion valves 51*a*, 51*b*, 51*c*, and 51*d* and is then sent to the utilization heat exchangers 52*a*, 52*b*, 52*c*, and 52*d*. The refrigerant sent to the utilization heat exchangers 52*a*, 52*b*, 52*c*, and 52*d* exchanges heat with indoor air supplied from the interior of the room by the utilization fans 55*a*, 55*b*, 55*c*, and 55*d* in the utilization heat exchangers 52*a*, 52*b*, 52*c*, and 52*d* each functioning as a refrigerant evaporator, so as to be heated and thus evaporated. The refrigerant thus evaporated flows out of the utilization units 3*a*, 3*b*, 3*c*, and 3*d*. Meanwhile, indoor air cooled in the utilization heat exchangers 52*a*, 52*b*, 52*c*, and 52*d* is sent into the room for cooling operation in the room.

The refrigerant having flown out of the utilization units 3*a*, 3*b*, 3*c*, and 3*d* is sent to the relay units 4*a*, 4*b*, 4*c*, and 4*d* via the second branching pipes 6*aa*, 6*bb*, 6*cc*, and 6*dd* of the gas-refrigerant connection pipe 6. The refrigerant sent to the relay units 4*a*, 4*b*, 4*c*, and 4*d* flows out of the relay units 4*a*, 4*b*, 4*c*, and 4*d* via the gas relay shutoff valves 68*a*, 68*b*, 68*c*, and 68*d*.

The refrigerant having flown out of the relay units 4*a*, 4*b*, 4*c*, and 4*d* joins through the gas-refrigerant connection pipe 6 (the junction pipe and the first branching pipes 6*a*, 6*b*, 6*c*, and 6*d*) to be sent to the heat source unit 2. The refrigerant sent to the heat source unit 2 is sucked into the compressor 21 via the gas-side shutoff valve 28, the switching mechanism 22, and the accumulator 29.

(2-2) Heating Operation

During heating operation in an exemplary case where all the utilization units 3*a*, 3*b*, 3*c*, and 3*d* execute heating operation (operation by each one of the utilization heat exchangers 52*a*, 52*b*, 52*c*, and 52*d* functioning as a refrigerant radiator and the heat source heat exchanger 23 functioning as a refrigerant evaporator), the switching mechanism 22 is switched into the heating operation state (the state depicted by the broken line for the switching mechanism 22 in FIG. 2) to drive the compressor 21, the heat source fan 24, and the utilization fans 55*a*, 55*b*, 55*c*, and 55*d*. Furthermore, the liquid relay shutoff valves 71*a*, 71*b*, 71*c*, and 71*d* and the gas relay shutoff valves 68*a*, 68*b*, 68*c*, and 68*d* of the relay units 4*a*, 4*b*, 4*c*, and 4*d* are fully opened.

The utilization control units 93*a*, 93*b*, 93*c*, and 93*d* operate the various constituent devices of the utilization units 3*a*, 3*b*, 3*c*, and 3*d* in this case. The utilization control units 93*a*, 93*b*, 93*c*, and 93*d* transmit information indicating that the utilization units 3*a*, 3*b*, 3*c*, and 3*d* execute heating operation to the heat source control unit 92 and the relay control units 94*a*, 94*b*, 94*c*, and 94*d* via the transmission lines 95 and 96. The various devices of the heat source unit 2 and the relay units 4*a*, 4*b*, 4*c*, and 4*d* are operated by the heat source control unit 92 and the relay control units 94*a*, 94*b*, 94*c*, and 94*d* having received information from the utilization units 3*a*, 3*b*, 3*c*, and 3*d*.

A high-pressure refrigerant discharged from the compressor 21 flows through the switching mechanism 22 and the gas-side shutoff valve 28 to flow out of the heat source unit 2.

The refrigerant having flown out of the heat source unit 2 is sent to the relay units 4*a*, 4*b*, 4*c*, and 4*d* via the gas-refrigerant connection pipe 6 (the junction pipe and the first branching pipes 6*a*, 6*b*, 6*c*, and 6*d*). The refrigerant sent to the relay units 4*a*, 4*b*, 4*c*, and 4*d* flows out of the relay units 4*a*, 4*b*, 4*c*, and 4*d* via the gas relay shutoff valves 68*a*, 68*b*, 68*c*, and 68*d*.

The refrigerant having flown out of the relay units 4*a*, 4*b*, 4*c*, and 4*d* is sent to the utilization units 3*a*, 3*b*, 3*c*, and 3*d* via the second branching pipes 6*aa*, 6*bb*, 6*cc*, and 6*dd* (portions included in the gas-refrigerant connection pipe 6 and connecting the relay units 4*a*, 4*b*, 4*c*, and 4*d* and the utilization units 3*a*, 3*b*, 3*c*, and 3*d*). The refrigerant sent to the utilization units 3*a*, 3*b*, 3*c*, and 3*d* is sent to the utilization heat exchangers 52*a*, 52*b*, 52*c*, and 52*d*. A high-pressure refrigerant sent to the utilization heat exchangers 52*a*, 52*b*, 52*c*, and 52*d* exchanges heat with indoor air supplied from the interior of the room by the utilization fans 55*a*, 55*b*, 55*c*, and 55*d* in the utilization heat exchangers 52*a*, 52*b*, 52*c*, and 52*d* each functioning as a refrigerant radiator, so as to be cooled and condensed. The refrigerant thus condensed is decompressed by the utilization expansion valves 51*a*, 51*b*, 51*c*, and 51*d* and then flows out of the utilization units 3*a*, 3*b*, 3*c*, and 3*d*. Meanwhile, indoor air heated in the utilization heat exchangers 52*a*, 52*b*, 52*c*, and 52*d* is sent into the room for heating operation in the room.

The refrigerant having flown out of the utilization units 3*a*, 3*b*, 3*c*, and 3*d* is sent to the relay units 4*a*, 4*b*, 4*c*, and 4*d* via the second branching pipes 5*aa*, 5*bb*, 5*cc*, and 5*dd* (the portions included in the liquid-refrigerant connection pipe 5 and connecting the relay units 4*a*, 4*b*, 4*c*, and 4*d* and the utilization units 3*a*, 3*b*, 3*c*, and 3*d*). The refrigerant sent to the relay units 4*a*, 4*b*, 4*c*, and 4*d* flows out of the relay units 4*a*, 4*b*, 4*c*, and 4*d* via the liquid relay shutoff valves 71*a*, 71*b*, 71*c*, and 71*d*.

The refrigerant having flown out of the relay units 4*a*, 4*b*, 4*c*, and 4*d* joins through the liquid-refrigerant connection pipe 5 (the junction pipe and the first branching pipes 5*a*, 5*b*, 5*c*, and 5*d*) to be sent to the heat source unit 2. The refrigerant sent to the heat source unit 2 is sent to the heat source expansion valve 25 via the liquid-side shutoff valve 27 and the refrigerant cooler 45. The refrigerant sent to the heat source expansion valve 25 is decompressed by the heat source expansion valve 25 and is then sent to the heat source heat exchanger 23. The refrigerant sent to the heat source heat exchanger 23 exchanges heat with outdoor air supplied by the heat source fan 24 to be heated and thus evaporated. The refrigerant thus evaporated is sucked into the compressor 21 via the switching mechanism 22 and the accumulator 29.

(3) Operation of Air Conditioner Upon Refrigerant Leakage

Operation of the air conditioner 1 upon refrigerant leakage will be described next with reference to a control flow depicted in FIG. 5. Similarly to the basic operation described above, the following operation of the air conditioner 1 upon refrigerant leakage is executed by the control unit 19 configured to control the constituent devices of the air conditioner 1 (the heat source unit 2, the utilization units 3*a*, 3*b*, 3*c*, and 3*d*, and the relay units 4*a*, 4*b*, 4*c*, and 4*d*).

Similar control is executed regardless of which one of the utilization units 3*a*, 3*b*, 3*c*, and 3*d* has refrigerant leakage. Described herein is an exemplary case of detection of refrigerant leakage into the room equipped with the utilization unit 3*a*.

Figure 5:
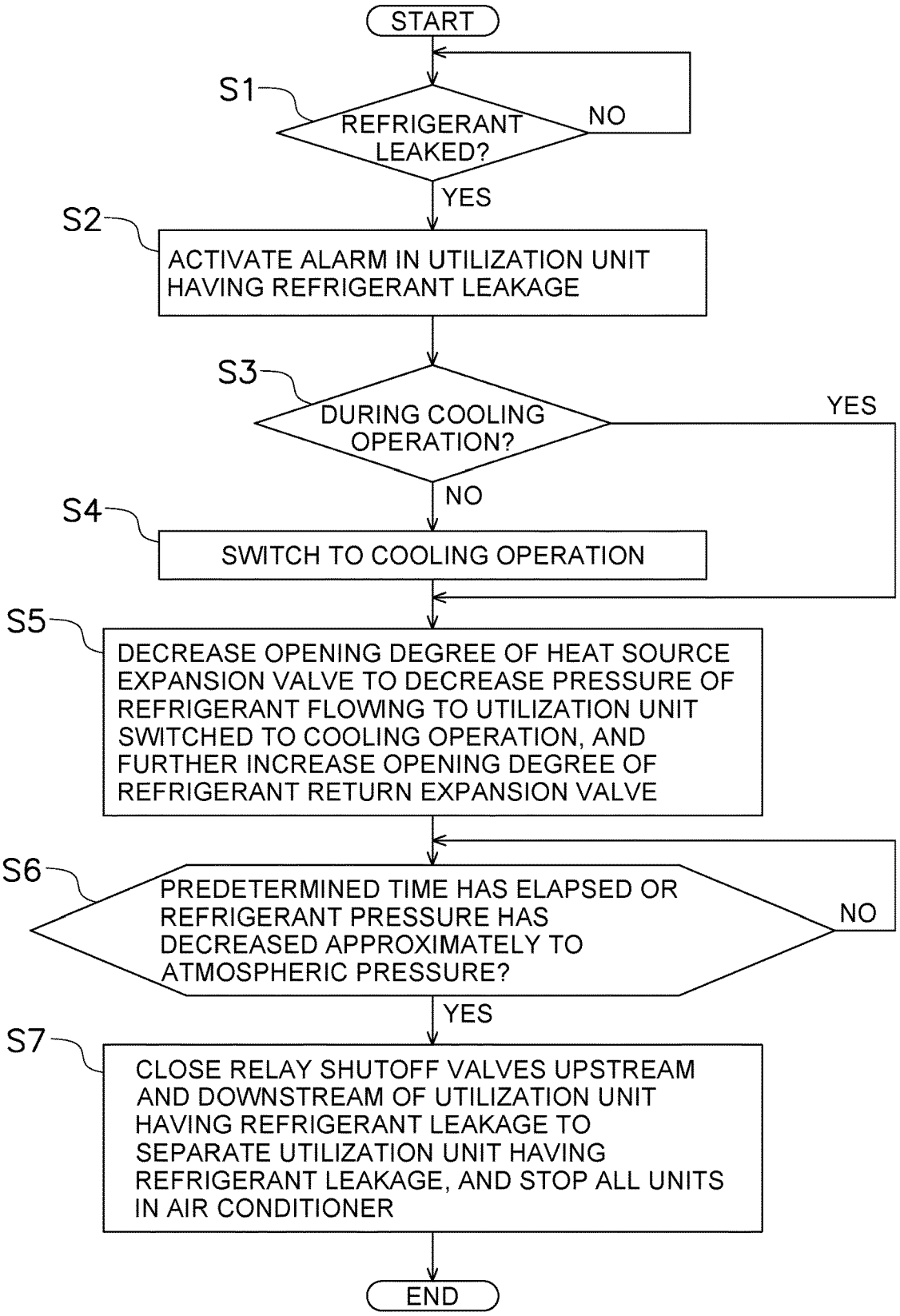
FIG. 5 is a chart depicting a control flow against refrigerant leakage.

Step S1 in FIG. 5 includes determining which one of the refrigerant leakage detection units 79*a*, 79*b*, 79*c*, and 79*d* of the utilization units 3*a*, 3*b*, 3*c*, and 3*d* detects refrigerant leakage. In a case where the refrigerant leakage detection unit 79*a* of the utilization unit 3*a* detects refrigerant leakage into the space (room) equipped with the utilization unit 3*a*, the flow transitions to subsequent step S2.

Step S2 includes alarming a person staying in the space equipped with the utilization unit 3*a* by means of an alarm device (not depicted) configured to activate with alarm sound such as buzzing and light a lamp in the utilization unit 3*a* having refrigerant leakage.

Subsequent step S3 includes determining whether or not the utilization unit 3*a* is executing cooling operation. In a case where the utilization unit 3*a* is executing heating operation or the utilization unit 3*a* is stopped or temporarily stopped without executing cooling operation or heating operation, the flow transitions from step S3 to step S4.

Step S4 includes causing the utilization unit 3*a* to execute cooling operation in order to decrease pressure of the refrigerant in the utilization unit 3*a*. Cooling operation in step S4 is different from ordinary cooling operation and prioritizes decreasing pressure of the refrigerant in the utilization unit 3*a*. When the air conditioner 1 executes heating operation, the switching mechanism 22 is switched into the cooling operation state to cause the air conditioner 1 to execute cooling operation. When the utilization unit 3*a* is stopped or temporarily stopped, the utilization unit 3*a* is brought into the cooling operation state for decrease in pressure of the refrigerant in the utilization unit 3*a*.

Step S5 subsequent to step S4 includes decreasing an opening degree of the heat source expansion valve 25 of the heat source unit 2. The heat source expansion valve 25 is fully opened during ordinary cooling operation. In this case, the opening degree of the heat source expansion valve 25 is decreased to decrease pressure of the refrigerant flowing to the utilization units 3*a*, 3*b*, 3*c*, and 3*d*. The utilization expansion valve 51*a* of the utilization unit 3*a* is fully opened.

Step S5 includes increasing an opening degree of the refrigerant return expansion valve 44 in comparison to the opening degree for ordinary cooling operation, in order to increase quantity of the refrigerant flowing in the refrigerant return pipe 41 serving as a bypass route. Thus, out of the refrigerant radiated heat and condensed in the heat source heat exchanger 23 and flowing to the utilization units 3*a*, 3*b*, 3*c*, and 3*d*, a larger portion of the refrigerant flows through the refrigerant return pipe 41 to return to the suction side of the compressor 21. In other words, a smaller portion of the refrigerant radiates heat to be condensed in the heat source heat exchanger 23, and flows to the utilization units 3*a*, 3*b*, 3*c*, and 3*d*. This control leads to quicker decrease in pressure of the refrigerant in the utilization unit 3*a* having refrigerant leakage. The refrigerant having flown through the refrigerant return pipe 41 flows into the accumulator 29. Part of the refrigerant thus having flown thereinto can thus be accumulated in the accumulator 29.

Step S5 further includes decreasing the number of revolutions of the utilization fan 55*a*.

Step S6 includes determining whether or not the refrigerant in the utilization unit 3*a* is sufficiently decreased in pressure in accordance with sensor values of the utilization heat exchange liquid-side sensor 57*a* and the utilization heat exchange gas-side sensor 58*a* of the utilization unit 3*a*. If the sensor values satisfy predetermined conditions and the refrigerant in the utilization unit 3*a* is determined as having sufficiently decreased in pressure, the flow transitions from step S6 to step S7. Step S6 also includes monitoring time elapse. If predetermined time has elapsed after operation in step S5, the pressure of the refrigerant in the utilization unit 3*a* is determined as having decreased to some extent and the flow transitions to step S7.

Step S6 includes monitoring pressure of the refrigerant in the utilization unit 3*a*, and the pressure of the refrigerant in the utilization unit 3*a* is controlled so as not to become substantially less than the atmospheric pressure. The flow transitions from step S6 to step S7 before the pressure of the refrigerant in the utilization unit 3*a* becomes less than the atmospheric pressure.

Step S7 includes closing the liquid relay shutoff valve 71*a* and the gas relay shutoff valve 68*a* of the relay unit 4*a* corresponding to the utilization unit 3*a* having refrigerant leakage. The utilization unit 3*a* is thus separated from the refrigerant circuit 10 having refrigerant circulation, to substantially stop the flow of the refrigerant from the heat source unit 2 to the utilization unit 3*a*. Subsequent step S7 includes stopping all the units including the remaining utilization units 3*b*, 3*c*, and 3*d* and the heat source unit 2.

(4) Selection of Liquid Relay Shutoff Valve and Gas Relay Shutoff Valve

As described above, the liquid relay shutoff valves 71*a*, 71*b*, 71*c*, and 71*d* and the gas relay shutoff valves 68*a*, 68*b*, 68*c*, and 68*d* are controlled to be closed upon detection of refrigerant leakage (see step S7 in FIG. 4). In other words, if refrigerant leakage is detected in any one of the utilization units 3*a*, 3*b*, 3*c*, and 3*d*, the liquid relay shutoff valve 71*a*, 71*b*, 71*c*, or 71*d* and the gas relay shutoff valve 68*a*, 68*b*, 68*c*, or 68*d* of the corresponding relay unit 4*a*, 4*b*, 4*c*, or 4*d* are switched from a non-shutoff state into the shutoff state where the shutoff valves are closed.

In the air conditioner 1 according to the present embodiment, the liquid relay shutoff valve 71*a*, 71*b*, 71*c*, or 71*d* and the gas relay shutoff valve 68*a*, 68*b*, 68*c*, or 68*d* are selected in the following manner. Any one of the liquid relay shutoff valves 71*a*, 71*b*, 71*c*, and 71*d* and the gas relay shutoff valves 68*a*, 68*b*, 68*c*, and 68*d* is selected in a same manner, and will thus be simply called a shutoff valve hereinafter.

(4-1) Regarding Room Equipped with Utilization Unit of Air Conditioner

Selection of a shutoff valve is preceded by acquisition of information on a building equipped with the air conditioner 1, specifically, information on the room equipped with the utilization units 3*a*, 3*b*, 3*c*, and 3*d*.

Figure 3:
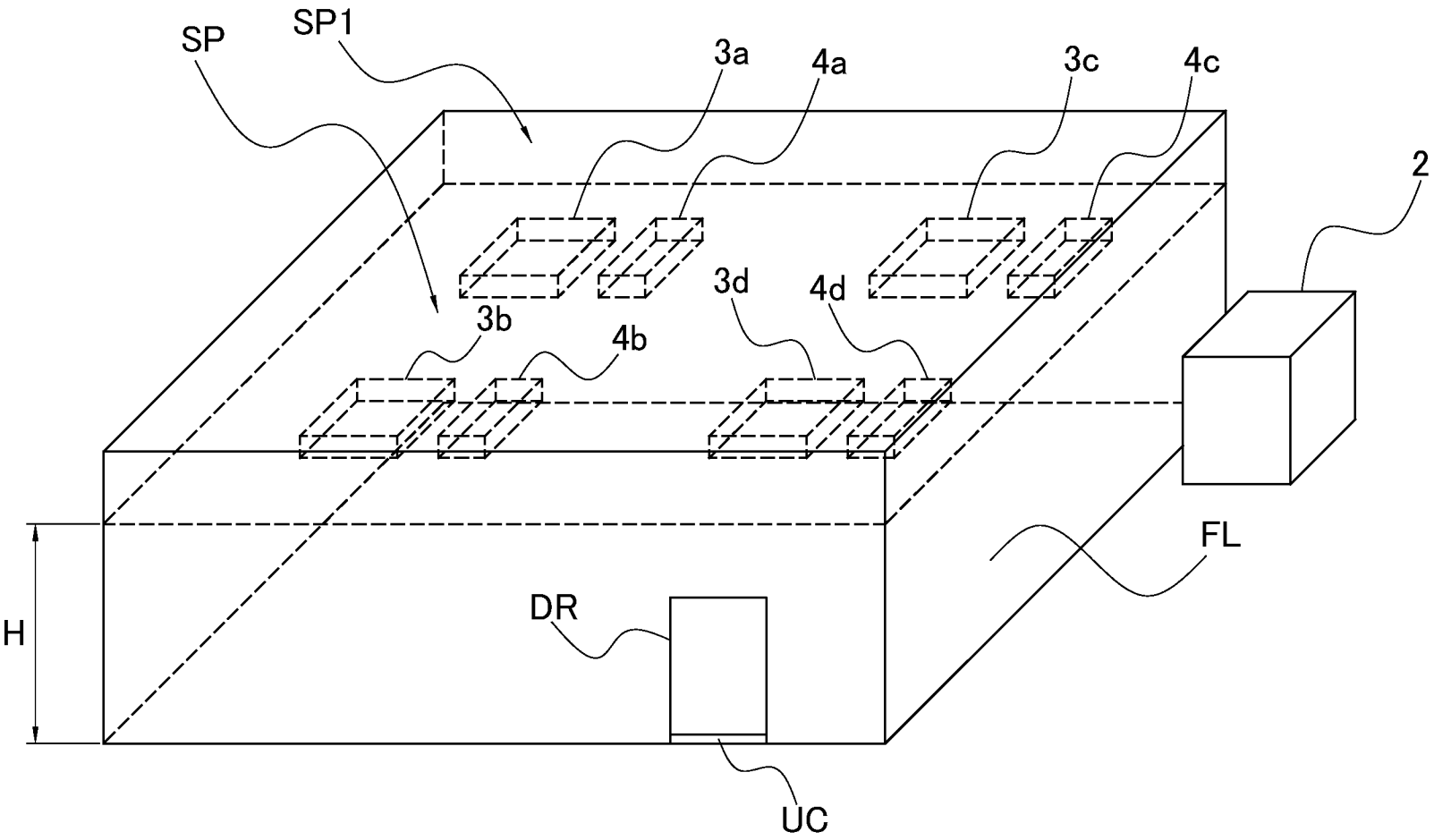
FIG. 3 is a diagram depicting a room equipped with the air conditioner.

In this case, the four utilization units 3*a*, 3*b*, 3*c*, and 3*d* as well as the relay units 4*a*, 4*b*, 4*c*, and 4*d* are disposed in the space SP1 behind the ceiling of the room (predetermined space) SP depicted in FIG. 3. The room SP has a floor FL not equipped with any utilization unit. In other words, the utilization units 3*a*, 3*b*, 3*c*, and 3*d* are to be installed at a ceiling and are not to be placed on a floor.

The room SP is provided with a door DR allowing a person to enter or leave the room. The door DR is closed when no person enters or leaves the room. The door DR is provided therebelow with a clearance (undercut portion) UC. The ceiling of the room SP is provided with a ventilating hole (not depicted). The clearance UC has an area of $A_d$ ($m^2$). In an exemplary case where the clearance UC is 4 mm in height and is 800 mm in width, the area $A_d$ of the clearance UC is 0.0032 ($m^2$) obtained by multiplying these values.

The utilization units 3*a*, 3*b*, 3*c*, and 3*d* are disposed in the space SP1 behind the ceiling of the room SP, so that a distance H from the floor FL to each of the utilization circuits 3*aa*, 3*bb*, 3*cc*, and 3*dd* of the utilization units 3*a*, 3*b*, 3*c*, and 3*d* is assumed to be equal to height (height of the ceiling) of the room SP.

(4-2) Regarding Maximum Tolerable Air Leakage Rate (Shutoff Leakage Rate) Tolerated when Shutoff Valve is in Shutoff State Described next in order is how to calculate the shutoff leakage rate, which is required for selection of the liquid relay shutoff valve and the gas relay shutoff valve. The following description refers generally to a shutoff valve and a utilization unit without specifying any of the shutoff valves or the utilization units uniquely included in the air conditioner 1 according to the present embodiment. The shutoff valve and the utilization unit will thus be described without any reference signs.

(4-2-1)

As described in the above "summary of the invention", in the "Annex A (Prescription) Specifications of safety shutoff valves" in the guideline by the Japan Refrigeration and Air Conditioning Industry Association, when fluid is air and a safety shutoff valve has 1 MPa as a differential pressure between upstream and downstream of the safety shutoff valve, 300 ($cm^3$/min) or less is prescribed as the closed valve leakage rate to be satisfied by the safety shutoff valve. Initially obtained is a valve clearance in a case where the shutoff valve is shut off in accordance with these conditions.

The valve clearance sectional area $A_v$ is obtained from an air volume flow rate, an air inlet absolute pressure, an air density, and an air specific heat ratio, and an equivalent diameter $d_v$ of the valve clearance is then obtained, assuming that the section has a circular shape. Air is assumed to have 1.40 as a specific heat ratio κ (20° C.). When a pressure ratio P2/P1 exceeds $(2/(\kappa+1))\times(\kappa/(\kappa-1))$, a flow velocity exceeds the sound velocity. At the above differential pressure, $$P2/P1 = (1 + 0.1013)/0.1013 = 10.87,$$

$$\text{and } (2/(\kappa + 1)) \times (\kappa/(\kappa - 1)) = (2/2.4) \times 1.4/0.4 = 0.528$$

are satisfied, and the flow velocity thus exceeds the supersonic velocity.

A mass flow rate $G_a$, a volume flow rate $Q_a$, and the valve clearance equivalent diameter $d_v$ are obtained in accordance with the following formulae. When the flow velocity exceeds the sound velocity, $$G_a = A_v \times (2/(\kappa + 1))^{((\kappa+1)/2(\kappa-1))} \times (\kappa \times P_{1a} \times \rho_{1a})^{0.5} \quad \text{(Formula 1)}$$

$$A_v = Q_a \times \rho_{2a} \times (2/(\kappa + 1))^{(-(\kappa+1)/2(\kappa-1))} \times (\kappa \times P_{1a} \times \rho_{1a})^{(-0.5)} \quad \text{(Formula 2)}$$

$$d_v = (4 \times A_v/\pi)^{0.5} \quad \text{(Formula 3)}$$

The above "Annex A (Prescription) Specifications of safety shutoff valves" specifies that the closed valve leakage rate (closed valve tolerable leakage rate) to be satisfied is 300 ($cm^3$/min) or less, which corresponds to $5\times10^{-6}$ ($m^3$/s). The guideline further specifies the identical closed valve tolerable leakage rate for shutoff valves on a liquid side connection pipe and a gas side connection pipe. Both the shutoff valves are thus assumed to have identical valve clearances.

This condition is substituted in (Formula 2) to obtain $A_v$. The above "Annex A (Prescription) Specifications of safety shutoff valves" tolerates a valve clearance ($d_vG$) and a valve clearance sectional area ($A_vG$) obtained by $$d_{vG} = d_{vL} = 5.47E-5 \ (m), \text{ and}$$

$$A_{vG} = A_{vL} = 2.24E-9 \ (m^2).$$

(4-2-2)

Calculated next is a leakage velocity $G_r$ of a refrigerant leaking from the valve clearance ($d_{vG}$) thus obtained.

This calculation is made assuming that a refrigerant in a liquid phase is located upstream of the shutoff valve viewed from the utilization unit in a liquid-side line (liquid-refrigerant connection pipe) and that a refrigerant in a gas phase is located upstream of the shutoff valve viewed from the utilization unit in a gas-side line (gas-refrigerant connection pipe).

A refrigerant leakage velocity ($G_{rL}$) on the liquid-side line is initially obtained in accordance with the Bernoulli's theorem assuming that a leakage hole serves as an orifice and a refrigerant in a liquid phase passes the leakage hole, by $$G_{rL} = C_r \times (2 \times \Delta P_r/\rho_{1rl})^{0.5} \times A_{vL} \times \rho_{1rl}. \quad \text{(Formula 4)}$$

The gas-side line has a refrigerant leakage velocity ($G_{rG}$) exceeding the sound velocity. The specific heat ratio κ is assumed to have a representative value equal to a value of saturated gas of the refrigerant at 20° C. The refrigerant leakage velocity ($G_{rG}$) on the gas-side line is obtained by $$G_{rG} = A_{vG} \times (2/(\lambda + 1))^{((\lambda+1)/2(\lambda-1))} \times (\lambda \times P_{1r} \times \rho_{1rg})^{0.5}. \quad \text{(Formula 5)}$$

In the case where both the shutoff valves on the liquid-side line and the gas-side line are closed, the leakage velocity $G_r$ of the refrigerant flowing into the room SP is obtained by $$\begin{aligned} G_r &= G_{rL} + G_{rG} \quad \text{(Formula 6)} \\ &= C_r \times (2 \times \Delta P_r/\rho_{1rl})^{0.5} \times A_{vL} \times \rho_{1rl} + \\ &\quad A_{vG} \times (2/(\lambda + 1))^{((\lambda+1)/2(\lambda-1))} \times \\ &\quad (\lambda \times P_{1r} \times \rho_{1rg})^{0.5}. \end{aligned}$$

Examples of variables influencing the leakage velocity of refrigerant through the valve clearance at the shutoff valve include (4-2-2-A) to (4-2-2-E). The variables are calculated in the following manners.

(4-2-2-A) Refrigerant Type

The refrigerant is assumed to be selected from R32, R452B, R454B, R1234yf, and R1234ze(E), and each of the refrigerants has a physical property value calculated in accordance with NIST Refprop V9.1.

(4-2-2-B) Ambient Temperature Determining Refrigerant Pressure Upstream of Shutoff Valve after Air Conditioner Stops, and Differential Pressure Between Refrigerant Pressure and Atmospheric Pressure After the air conditioner stops, pressure of the refrigerant closer to the heat source unit rather than (upstream of) the shutoff valve can be assumed to be determined by maximum temperature outside a building. In accordance with high temperature test conditions for air conditioners in the USA (Table 1 below), the maximum outside temperature is set to 55° C. and refrigerant pressure upstream of the shutoff valve is set to saturation pressure at 55° C.

TABLE 1

| Test condition | Outdoor [a] Dry-bulb temperature ° C. (° F.) | Indoor Dry-bulb temperature ° C. (° F.) | Wet-bulb temperature ° C. (° F.) | Dew point temperature [b] ° C. (° F.) | Relative humidity [b] % |
|---|---|---|---|---|---|
| AHRI B [C] | 27.8 (82) | 26.7 (80.0) | 19.4 (67) | 15.8 (60.4) | 50.9 |
| AHRI A [C] | 35.0 (95) | 26.7 (80.0) | 19.4 (67) | 15.8 (60.4) | 50.9 |
| T3* [d] | 46 (114.8) | 26.7 (80.0) | 19 (66.2) | 15.8 (60.4) | 50.9 |
| T3 | 46 (114.8) | 29 (84.2) | 19 (66.2) | 13.7 (56.6) | 39 |
| Hot | 52 (125.6) | 29 (84.2) | 19 (66.2) | 13.7 (56.6) | 39 |
| Extreme | 55 (131) | 29 (84.2) | 19 (66.2) | 13.7 (56.6) | 39 |

[a] There is no specification for the outdoor relative humidity as it has no impact on the performance.

[b] Dew-point temperature and relative humidity evaluated at 0.973 atm (14.3 psi)

[C] Per AHRI Standard 210/240

[d] T3* is a modified T3 condition in which the indoor settings are similar to the AHRI conditions.

Source:

Alternative Refrigerant Evaluation for High-Ambient-Temperature Environments: R-22 and R-410A Alternatives for Mini-Split Air Conditioners, ORNL, P5, 2015

(4-2-2-C) Liquid Density and Gas Density

Liquid density as the mass concentration (kg/m$^3$) of a refrigerant in a liquid phase, and the mass concentration (kg/m$^3$) of a refrigerant in a gas phase are calculated in accordance with NIST Refprop V9.1.

(4-2-2-D) Specific Heat Ratio

The specific heat ratio is calculated in accordance with NIST Refprop V9.1. Adopted is a specific heat ratio of saturated gas of the refrigerant at 27° C.

(4-2-2-E) Refrigerant States on Liquid-Side Line and Gas-Side Line

Assumed after the shutoff valve is brought into the shutoff state are whether the refrigerant on the liquid-side line and the refrigerant on the gas-side line upstream of the shutoff valve are in the liquid phase and in the gas phase or are in the gas phase and in the gas phase, respectively. In this embodiment, calculation is made assuming the former case where a calculated refrigerant leakage rate is larger. In other words, calculation is made after the shutoff valve is brought into the shutoff state, assuming that the refrigerant on the liquid-side line upstream of the shutoff valve is in the liquid phase and the refrigerant on the gas-side line upstream of the shutoff valve is in the gas phase.

When the variables are calculated as described above, the leakage velocity of each refrigerant leaking from the valve clearance is indicated in Table 2 below.

Conditions: assuming ambient temperature at 55 [° C.], shutoff valve clearance corresponding to 300 [cc/min], and specific heat ratio having value at 27 [° C.]

Leakage velocities at varied ambient temperatures (temperatures outside a building) can be obtained in accordance with (Formula 4), (Formula 5), and (Formula 6) by varying the physical property values. The leakage velocity tends to be larger as the ambient temperature is higher. Shutoff valves adapted to various regions can thus be selected and designed by obtaining the leakage velocities in accordance with conditions of outside temperatures (maximum outside temperatures) in the various regions.

(4-2-3)

Calculated next is a refrigerant discharge velocity $G_d$ of the refrigerant discharged from the room through the clearance UC below the door DR.

$$G_d = \rho_{md} \times V_{md} \times A_d \quad \text{(Formula 7)}$$

$$V_{md} = C_d \times (2 \times \Delta p_d / \rho_{md})^{0.5} \quad \text{(Formula 8)}$$

$$\Delta p_d = (\rho_{md} - \rho_a) \times g \times h_s \quad \text{(Formula 9)}$$

$$\rho_{md} = \rho_{mr} + \rho_{ma} \quad \text{(Formula 10)}$$

$$\rho_{mr} = N/100 \times (U_r \times 10^{-3})/(24.5 \times 10^{-3}) \quad \text{(Formula 11)}$$

$$\rho_{ma} = (100 - N)/100 \times (U_a \times 10^{-3})/(24.5 \times 10^{-3}) \quad \text{(Formula 12)}$$

$$N = LFL/S \quad \text{(Formula 13)}$$

TABLE 2

Leakage velocity of refrigerant through valve clearance when shutoff valve is shut off

| Refrigerant | Refrigerant pressure $P_{1r}$ [Mpa] | Liquid density $P_{1rl}$ [kg/m3] | Gas density $P_{1rg}$ [kg/m3] | Specific heat ratio λ[—] | Liquid side leakage velocity $G_{rl}$ [kg/h] | Gas side leakage velocity $G_{rg}$[kg/h] | Sum of leakage velocities $G_r$ [kg/h] |
|---|---|---|---|---|---|---|---|
| R32 | 3.52 | 808 | 115.0 | 1.71 | 0.377 | 0.125 | 0.502 |
| R1234yf | 1.46 | 967 | 87.0 | 1.21 | 0.261 | 0.062 | 0.323 |
| R1234(E) | 1.13 | 1054 | 61.3 | 1.17 | 0.236 | 0.045 | 0.282 |
| R452B | 3.08 | 854 | 106.0 | 1.88 | 0.362 | 0.115 | 0.477 |
| R454B | 3.00 | 853 | 99.4 | 1.87 | 0.357 | 0.110 | 0.467 |

Examples of variables influencing the refrigerant discharge velocity include (4-2-3-A) and (4-2-3-B).

(4-2-3-A) Leakage Height (4-2-3-B) Safety Coefficient for LFL of Average Refrigerant Concentration in Room The leakage height is 2.2 m or the like when the utilization unit is installed at the ceiling and is 0.6 m or the like when the utilization unit is placed on the floor (see IEC60335-2-40: 2016). A tolerable average concentration is obtained by dividing LFL by the safety coefficient. The refrigerant discharge velocity is influenced by the safety coefficient set to four or two, as exemplarily indicated by Table 3 below.

TABLE 3

| Refrigerant discharge velocity Gd [kg/h] to outside room through clearance below door | | | | | |
|---|---|---|---|---|---|
| Tolerable average concentration | | 1/4LFL | 1/4LFL | 1/2LFL | 1/2LFL |
| Leakage height | | 2.2 m | 0.6 m | 2.2 m | 0.6 m |
| Refrigerant | R32 | 0.983 | 0.153 | 2.714 | 1.417 |
| | R1234yf | 1.152 | 0.594 | 3.149 | 1.645 |
| | R1234ze(E) | 1.220 | 0.637 | 3.374 | 1.762 |
| | R452B | 1.092 | 0.570 | 3.036 | 1.586 |
| | R454B | 1.063 | 0.555 | 2.957 | 1.544 |

(4-2-4)

Calculated next is a maximum tolerable air leakage rate ($Q_{max}$) of the shutoff valve in the shutoff state in the case where the door DR is provided therebelow with the clearance UC.

When the discharge velocity $G_d$ of the refrigerant out of the room SP through the clearance UC is larger than the leakage velocity $G_r$ of the refrigerant through the valve clearance of the shutoff valve in the shutoff state, a tolerable air leakage rate can be made larger than 300 ($cm^3$/min). As mentioned above in (4-2-1), if the shutoff valves on the liquid-side line and the gas-side line are set to have the identical maximum tolerable air leakage rate ($Q_{max}$), a multiplying factor R for 300 ($cm^3$/min) specified by the guideline of the Japan Refrigeration and Air Conditioning Industry Association is identical for the shutoff valves on the liquid-side line and the gas-side line.

$$R = G_d/G_r \quad \text{(Formula 14)}$$

$$Q_{max} = 300 \times R \quad \text{(Formula 15)}$$

Assume herein that, before the shutoff valves are brought into the shutoff state, a refrigerant in a liquid phase is provided upstream of the shutoff valve on the liquid-side line, and a refrigerant in a gas phase is provided upstream of the shutoff valve on the gas-side line. (Formula 16) is obtained by substituting (Formula 6) and (Formula 8) in (Formula 15).

$$R = (\rho_{md} \times V_{md} \times A_d)/\left(C_r \times (2 \times \Delta P_r/\rho_{1rl})^{0.5} \times A_v \times \rho_{1rl} + A_v \times (2/(\lambda+1))^{((\lambda+1)/2(\lambda-1))} \times (\lambda \times P_{1r} \times \rho_{1rg})^{0.5}\right) \quad \text{(Formula 16)}$$

The tolerable multiplying factor R for each of the refrigerants is obtained in accordance with (Formula 16), as exemplarily indicated in Table 4.

TABLE 4

| Tolerable multiplier R of maximum tolerable air leakage rate Qv | | | | | |
|---|---|---|---|---|---|
| Tolerable average concentration | | 1/4LFL | 1/4LFL | 1/2LFL | 1/2LFL |
| Leakage height | | 2.2 m | 0.6 m | 2.2 m | 0.6 m |
| Refrigerant | R32 | 1.96 | 1.02 | 5.41 | 2.83 |
| | R1234yf | 3.57 | 1.84 | 9.76 | 5.10 |
| | R1234ze(E) | 4.33 | 2.26 | 11.98 | 6.26 |
| | R452B | 2.29 | 1.20 | 6.37 | 3.32 |
| | R454B | 2.28 | 1.19 | 6.33 | 3.31 |

(4-2-5)

Considered next is a refrigerant leakage hole opened in the utilization circuit of the utilization unit in accordance with investigation results of refrigerant leakage actually occurred on the market.

There has been reported a case where refrigerant leakage occurred by a hole opened due to corrosion or the like at part of a utilization circuit of a utilization unit in an air conditioner. According to the "Report of risk assessment of building multi air conditioners using lower flammability refrigerants" by the Japan Refrigeration and Air Conditioning Industry Association (issued on Sep. 20, 2017), utilization units having actually caused refrigerant leakage are collected from the market and investigated to find a maximum leakage hole diameter of 0.174 mm. This value corresponds to 3.18 times the valve clearance equivalent diameter $d_v$=5.47E−2 (mm) for the shutoff valve in the shutoff state. A sectional area obtained from this value is 10.1 times the sectional area of the valve clearance. Upon decrease of the maximum tolerable air leakage rate $Q_{max}$ of the shutoff valve in the shutoff state, the shutoff valve is installed uselessly if the valve clearance of the shutoff valve is set to be larger than the leakage hole diameter of the utilization unit. The tolerable multiplying factor R will thus be appropriately set so as not to exceed 10.1 times.

(4-2-6)

Described above is calculation of the shutoff leakage rate and the like. Symbols and the like included in the formulae indicate as follows in (4-2-6-1) to (4-2-6-3) unless otherwise specified.

(4-2-6-1) Symbols

A: area ($m^2$ as unit)

C: flow rate coefficient d: equivalent diameter (m as unit)

G: mass flow rate velocity ($kg \cdot s^{-1}$ as unit)

g: gravitational acceleration ($m \cdot s^{-2}$ as unit)

h: leakage height (m as unit)

L: refrigerant lower flammable limit (LFL) ($kg \cdot m^{-3}$ as unit)

N: refrigerant volume concentration (vol % as unit)

P: pressure (Pa as unit)

Q: volume flow rate velocity ($m^3 \cdot s^{-1}$ as unit)

R: valve leakage rate tolerable multiplier

Δp: differential pressure (Pa as unit)

S: safety coefficient

U: refrigerant molecular weight v: velocity ($m \cdot s^{-1}$ as unit)

(4-2-6-2) Greek Letters

κ: air specific heat ratio

λ: refrigerant specific heat ratio

ρ: mass concentration ($kg \cdot m^{-3}$ as unit)

(4-2-6-3) Subscripts $_a$: air $_d$: clearance below door $_g$: gas phase
$_l$: liquid phase
$_m$: mixture of refrigerant and air
$_r$: refrigerant
$_s$: refrigerant leakage point
$_v$: shutoff valve
$_G$: gas-side line
$_L$: liquid-side line
$_1$: upstream
$_2$: downstream
$_{max}$: tolerance (5) Characteristics of Air Conditioner (5-1)

In the air conditioner 1, the maximum tolerable air leakage rate (shutoff leakage rate) required for the shutoff valve is calculated in the manner mentioned above in (4-2) in accordance with the conditions such as the size of the room SP equipped with the utilization units 3*a*, 3*b*, 3*c*, and 3*d* (the size of the clearance UC below the door DR or the height of the ceiling), the type of the refrigerant (R32), and the places equipped with the utilization units 3*a*, 3*b*, 3*c*, and 3*d* (installed at the ceiling instead of placed on the floor), to determine the specifications of the liquid relay shutoff valves 71*a*, 71*b*, 71*c*, and 71*d* and the gas relay shutoff valves 68*a*, 68*b*, 68*c*, and 68*d*. Specifically, calculated is the multiplying factor R for 300 ($cm^3$/min) as a reference value of the shutoff leakage rate in the specifications prescribed by the Annex A of the guideline, as to how the tolerable rate can be increased for 300 ($cm^3$/min). The specific numerical value of the multiplying factor R is obtained as indicated in Table 4. Herein, in the case where R32 is adopted as the refrigerant, the utilization units 3*a*, 3*b*, 3*c*, and 3*d* are installed at the ceiling of the room SP, and the safety coefficient S is set to four, the multiplying factor R is 1.96 as indicated in Table 4.

In accordance with the multiplying factor R, the specifications of the liquid relay shutoff valves 71*a*, 71*b*, 71*c*, and 71*d* and the gas relay shutoff valves 68*a*, 68*b*, 68*c*, and 68*d* are determined in the air conditioner 1 such that the maximum tolerable air leakage rate (shutoff leakage rate) is 300×1.96 ($cm^3$/min) or less. In comparison to the case where the specifications are determined in accordance with 300 ($cm^3$/min) as the reference value, the liquid relay shutoff valves 71*a*, 71*b*, 71*c*, and 71*d* and the gas relay shutoff valves 68*a*, 68*b*, 68*c*, and 68*d* are reduced in production cost or purchase cost, to even reduce introduction cost for the air conditioner 1 including the refrigerant (R32) preventing global warming.

Also in the air conditioner 1 including the liquid relay shutoff valves 71*a*, 71*b*, 71*c*, and 71*d* and the gas relay shutoff valves 68*a*, 68*b*, 68*c*, and 68*d* having the specifications thus determined, quantity of the refrigerant flowing out of the room SP through the valve clearance of each of the liquid relay shutoff valve 71*a* and the gas relay shutoff valve 68*a* after the air conditioner 1 stops in step S7 in FIG. 5 is suppressed to allow the refrigerant concentration to be kept sufficiently low than LFL in the room SP.

(5-2)

As mentioned above in (4-2-5), there is no point of shutoff if the maximum tolerable air leakage rate (shutoff leakage rate) is excessively large for each of the liquid relay shutoff valves 71*a*, 71*b*, 71*c*, and 71*d* and the gas relay shutoff valves 68*a*, 68*b*, 68*c*, and 68*d*.

In view of the market investigation result, the air conditioner 1 is thus set to have 300×10.1=3030 ($cm^3$/min) as an upper limit value of the maximum tolerable air leakage rate (shutoff leakage rate) for each of the liquid relay shutoff valves 71*a*, 71*b*, 71*c*, and 71*d* and the gas relay shutoff valves 68*a*, 68*b*, 68*c*, and 68*d*.

(6) Modification Examples (6-1)

The air conditioner 1 according to the embodiment described above is installed in a room of a building. When the air conditioner 1 is installed in a space in a different building, selection in terms of the specifications of the shutoff valve may be changed in accordance with conditions of such a target space. Appropriate shutoff valves can be selected for various spaces such as a space in a plant, a kitchen, a data sensor, a computer room, and a space in a commercial facility.

(6-2)

The above embodiment exemplifies R32 as the refrigerant circulating in the refrigerant circuit 10 of the air conditioner 1. When there is adopted any one of different lower flammability refrigerants such as R1234yf, R1234ze(E), and R452B, the multiplying factor R is calculated in accordance with a difference in condition such as a refrigerant molecular weight or LFL as described above, for selection of specifications of the shutoff valve appropriate for the multiplying factor R.

(6-3)

The above embodiment exemplifies the control flow depicted in FIG. 5 as the operation of the air conditioner 1 upon refrigerant leakage. The air conditioner 1 can alternatively adopt different operation as operation upon refrigerant leakage. Alternatively, pumping down operation may be executed upon detection of refrigerant leakage, and the shutoff valve may then be controlled to be closed.

(6-4)

In the above embodiment, in step S4 and step S5, the utilization units 3*a*, 3*b*, 3*c*, and 3*d* execute cooling operation and the heat source expansion valve 25 is decreased in opening degree to decrease pressure of the refrigerant flowing to the utilization units 3*a*, 3*b*, 3*c*, and 3*d*. This control is merely exemplary and may alternatively be replaced with different control.

Upon detection of refrigerant leakage into the space equipped with the utilization unit 3*a*, only the liquid relay shutoff valve 71*a* and the gas relay shutoff valve 68*a* of the relay unit 4*a* corresponding to the utilization unit 3*a* may alternatively be closed immediately.

Upon detection of refrigerant leakage into the space equipped with the utilization unit 3*a*, there may still alternatively be adopted control to close all the liquid relay shutoff valves 71*a*, 71*b*, 71*c*, and 71*d* and the gas relay shutoff valves 68*a*, 68*b*, 68*c*, and 68*d* to separate all the utilization units 3*a*, 3*b*, 3*c*, and 3*d* from the heat source unit 2, as well as stop the compressor 21 of the heat source unit 2.

(6-5)

The above embodiment exemplifies, as the utilization unit, the utilization units 3*a*, 3*b*, 3*c*, and 3*d* installed to be buried in the ceiling. The shutoff valve is selected in a similar manner even with any utilization unit in a different form. The multiplying factor R can be obtained in accordance with (Formula 16) even when the utilization unit is of a ceiling pendant type, of a floor placement type, of a wall mounted type to be mounted on a side wall, or the like.

The embodiment of the present disclosure has been described above. Various modifications to modes and details should be available without departing from the object and the scope of the present disclosure recited in the claims.

REFERENCE SIGNS LIST

1: air conditioner (refrigerant cycle apparatus)
2: heat source unit
3*a*, 3*b*, 3*c*, 3*d*: utilization unit
3*aa*, 3*bb*, 3*cc*, 3*dd*: utilization circuit
5: liquid-refrigerant connection pipe
6: gas-refrigerant connection pipe
10: refrigerant circuit
19: control unit
68*a*, 68*b*, 68*c*, 68*d*: gas relay shutoff valve (second shutoff valve)
71*a*, 71*b*, 71*c*, 71*d*: liquid relay shutoff valve (first shutoff valve)
79*a*, 79*b*, 79*c*, 79*d*: refrigerant leakage detection unit (detection unit)
222: heat source circuit

CITATION LIST

Patent Literature

Non Patent Literature 1: Guideline of design construction for ensuring safety against refrigerant leakage from commercial air conditioners using lower flammability (A2L) refrigerants (JRA GL-16: 2017; The Japan Refrigeration and Air Conditioning Industry Association) and Annex A (Prescription) Specifications of safety shutoff valves

The invention claimed is:

1. A refrigerant cycle apparatus configured to circulate a lower flammability refrigerant categorized in lower flammability refrigerants by ISO 817 in a refrigerant circuit, the refrigerant cycle apparatus comprising:

a first shutoff valve provided on a first side of a first portion of the refrigerant circuit and a second shutoff valve provided on a second side of the first portion of the refrigerant circuit;

a detector configured to detect refrigerant leakage from the first portion of the refrigerant circuit into a predetermined space; and a controller configured to bring each of the first shutoff valve and the second shutoff valve into a shutoff state when the detector detects refrigerant leakage into the predetermined space, to inhibit refrigerant leakage into the predetermined space; wherein each of the first shutoff valve and the second shutoff valve in the shutoff state has a shutoff leakage rate, measured as an air leakage rate when fluid is air at 20° C. and a differential pressure between upstream and downstream of each valve is 1 MPa, said shutoff leakage rate being more than 300 ($cm^3$/min), and less than 300×R ($cm^3$/min), in which $$R = (\rho_{md} \times V_{md} \times A_d) / \left( C_r \times (2 \times \Delta P_r / \rho_{1rl})^{0.5} \times A_v \times \rho_{1rl} + A_v \times (2/(\lambda+1))^{((\lambda+1)/2(\lambda-1))} \times (\lambda \times P_{1r} \times \rho_{1rg})^{0.5} \right),$$

wherein $A_v$ is a valve clearance sectional area ($m^2$) of each of the first shutoff valve and the second shutoff valve in the shutoff state, $\rho_{1rl}$ is a mass concentration ($kg/m^3$) of a refrigerant in a liquid phase, $\rho_{1rg}$ is a mass concentration ($kg/m^3$) of a refrigerant in a gas phase, $P_{1r}$ is an upstream refrigerant pressure (MPa) of each of the first shutoff valve and the second shutoff valve, as a refrigerant saturation pressure when maximum temperature outside a building is set to 55° C., $\lambda$ is a refrigerant specific heat ratio, $\rho_{md}$ is a mass concentration ($kg/m^3$) of a gaseous mixture containing air and a refrigerant having reached a refrigerant tolerable average concentration in the predetermined space after refrigerant leakage into the predetermined space and passing a clearance of a door that partitions an area inside the predetermined space from an area outside the predetermined space, $V_{md}$ is a velocity (m/s) of the gaseous mixture containing air and the refrigerant having reached the refrigerant tolerable average concentration in the predetermined space after refrigerant leakage into the predetermined space and passing the clearance of the door partitioning into inside and outside the predetermined space, $A_d$ is an area ($m^2$) of the clearance of the door that partitions the area inside the predetermined space from the area outside the predetermined space, $\Delta P_r$ is a pressure difference (Pa) between inside and outside a hole at a position where the refrigerant leaks, as a differential pressure between the refrigerant saturation pressure when the maximum temperature outside the building is set to 55° C. and an atmospheric pressure, and $C_r$ is 0.6 as a refrigerant flow rate coefficient in a case where the refrigerant in the liquid phase passes the hole at the position where the refrigerant leaks.

2. The refrigerant cycle apparatus according to claim 1, wherein R satisfies $1<R<10.1$.

3. The refrigerant cycle apparatus according to claim 1, wherein the refrigerant circuit includes a utilization circuit included in a utilization unit provided in the predetermined space or in a space communicating with the predetermined space, a heat source circuit included in a heat source unit, and a liquid-refrigerant connection pipe and a gas-refrigerant connection pipe connecting the utilization circuit and the heat source circuit, the first portion of the refrigerant circuit corresponds to the utilization circuit, the first shutoff valve is provided on the liquid-refrigerant connection pipe, and the second shutoff valve is provided on the gas-refrigerant connection pipe.

4. The refrigerant cycle apparatus according to claim 2, wherein the refrigerant circuit includes a utilization circuit included in a utilization unit provided in the predetermined space or in a space communicating with the predetermined space, a heat source circuit included in a heat source unit, and a liquid-refrigerant connection pipe and a gas-refrigerant connection pipe connecting the utilization circuit and the heat source circuit, the first portion of the refrigerant circuit corresponds to the utilization circuit, the first shutoff valve is provided on the liquid-refrigerant connection pipe, and the second shutoff valve is provided on the gas-refrigerant connection pipe.

* * * * *